US005317894A

United States Patent [19]

Southard

[11] Patent Number: 5,317,894

[45] Date of Patent: Jun. 7, 1994

[54] QUICK CHANGE INSERT SYSTEM

[75] Inventor: Harold Southard, Rockford, Ill.

[73] Assignee: Rockford Products Corporation, Rockford, Ill.

[21] Appl. No.: 31,236

[22] Filed: Mar. 12, 1993

[51] Int. Cl.[5] ..... B21D 37/04

[52] U.S. Cl. ..... 72/481; 72/462; 279/97

[58] Field of Search ..... 72/462, 481; 279/86, 279/89, 93, 97; 83/698

[56] References Cited

U.S. PATENT DOCUMENTS

| | | | |
|---|---|---|---|
| 1,785,495 | 12/1930 | Richard | 83/698 |
| 1,789,830 | 1/1931 | Ostlund | 279/97 |
| 1,809,308 | 6/1931 | Mueller | 279/97 |
| 2,378,806 | 6/1945 | Stellin | 279/97 |
| 3,390,897 | 8/1965 | Moore | 285/33 |
| 3,549,182 | 12/1970 | Boque et al. | 287/52.08 |
| 4,483,638 | 11/1984 | Marie et al. | 72/481 |
| 4,854,765 | 8/1989 | Giles | 403/30 |
| 4,903,420 | 2/1990 | Kreitzberg et al. | 37/195 |
| 5,116,072 | 5/1992 | Swenson | 280/511 |

FOREIGN PATENT DOCUMENTS

| | | | |
|---|---|---|---|
| 0168454 | 10/1983 | Japan | 72/481 |
| 0686803 | 9/1979 | U.S.S.R. | 72/481 |
| 1493375 | 7/1989 | U.S.S.R. | 72/481 |

*Primary Examiner*—David Jones
*Attorney, Agent, or Firm*—Arnold, White & Durkee

[57] ABSTRACT

The quick change insert system of the present invention utilizes a removable locking pin and an insert sleeve to permit easy replacement of an insert pin within a sleeve. Insert pin replacement occurs by removing the locking pin. After removing the locking pin, the insert sleeve is removed together with the insert pin. The insert pin is separated from the insert sleeve, and a replacement insert pin is put in its place. The new insert pin and the insert sleeve slide back into the sleeve, and the locking pin secures the insert pin and the insert sleeve to the sleeve. The present invention does not require the removing or re-adjusting of the sleeve during insert pin replacement. Furthermore, the present invention permits easy replacement of other sleeve assembly parts during part to part changeover and eliminates costly inventory of sleeve assemblies.

14 Claims, 4 Drawing Sheets

QUICK CHANGE INSERT SYSTEM

FIELD OF THE INVENTION

The present invention generally relates to an apparatus that allows the quick and efficient replacement of an insert pin by removing a locking pin that engages an insert sleeve. More particularly, this invention relates to a quick change insert system for use in a cold-forming header in the metal cold-forming industry.

BACKGROUND OF THE INVENTION

Cold-forming involves the manufacture of a variety of metal parts and component, such as screws and bolts, at room temperature. The cold-forming process starts with a coil of wire or rod that is fed into a cold header. The cold header cuts the wire at an appropriate length and progressively forms the cut-off portion or slug into a specific shape through a series of punches and dies.

Cold-forming provides several advantages over other methods for manufacturing similar parts. Cold-forming wastes less materials because almost all of the material is reshaped to form the finished part, leaving virtually no scrap behind. The cold-formed part is stronger than parts made from other manufacturing processes because cold-forming causes the grain flow to follow the part configuration. Cold-formed products have consistent strength and dimensional accuracy and maintain a good appearance and finish. Other manufacturing processes require a finishing operation. Cold-forming also has phenomenal production rates when compared with other production processes and is the fastest production process for many parts. Additionally, cold-forming permits the combining of separate parts into a one-piece component that is stronger than the combined separate parts and reduces assembly operations required of other manufacturing processes.

Cold-forming is performed in a cold header or cold former in reference to the fact that they form steel into specific shapes at room temperature. Coiled wire or rod is fed into the cold header. The cold header cuts the wire or rod into cutoff slugs or blanks of a specified amount. The cold header forms these cut-off slugs into the specific shape of the final product. A blow or ram side of the cold header forces the cut-off slugs into a die in the die side of the cold header and causes the slug to conform to the shape of the die.

The ram side includes a sleeve assembly that is secured to a bolster plate on the ram side. The sleeve assembly includes a sleeve that surrounds packing and a frequently replaced insert pin. The ram side and the sleeve assembly move between a back position and a forward position while the die side of the cold header remains stationary. In the back position, the ram side is separated from the die side of the cold header, and a cut-off slug is positioned between the insert pin of the sleeve assembly and an opening to the die on the die side of the cold header. In moving to the forward position, the insert pin of the sleeve assembly rams the cut-off slug into the die on the die side of the cold header. As the insert pin pushes the cut-off slug into the die, the slug is extruded to the shape or diameter required. When the ram side returns to the back position, an ejector pin ejects the slug and completes the cold-forming operation. A cut-off slug may require a succession of cold-forming operations for a completed part.

During these cold-forming operations, insert pins commonly break and packings become damaged, requiring replacement. The current design of the blow assembly requires that the entire sleeve assembly be removed from the bolster plate on ram side of the cold header in order to replace the insert pin and the packings. After the sleeve assembly is removed and replaced, a significant time is spent in re-adjusting the location of the sleeve. The current sleeve assembly wastes time and money because the current sleeve design does not provide for part replacement without removing the entire sleeve assembly.

Moreover, the current sleeve assembly presents certain cost inefficiencies. The present cold-headers require that a new sleeve and insert pin be made and kept in inventory for each new job. New jobs require different insert pins because the diameter of the insert pin changes for different jobs. The sleeve assembly remains assembled in inventory because the sleeve, the packing and the insert pin are all part specific. Thus, the present sleeve assembly is cost inefficient because the current sleeve assembly design requires a large inventory of sleeve assemblies for a cold-forming manufacturer.

SUMMARY OF THE INVENTION

The present invention eliminates the time and cost inefficiencies caused by the current sleeve assembly design. The sleeve assembly of the present invention utilizes a removable locking pin and an insert sleeve to permit easy replacement of an insert pin within a sleeve. Insert pin replacement occurs by removing the locking pin. After removing the locking pin, the insert sleeve is removed together with the insert pin. The insert pin is separated from the insert sleeve, and a replacement insert pin is put in its place. The new insert pin and the insert sleeve slide back into the sleeve, and the locking pin secures the insert pin and the insert sleeve to the sleeve. The present invention does not require the removing or readjusting of the sleeve during insert pin replacement. Furthermore, the present invention permits easy replacement of other sleeve assembly parts during part to part changeover.

In a preferred embodiment of the quick change system of the present invention, the sleeve remains clamped to the bolster plate on the ram side of the cold header during insert pin changes. An operator removes the locking pin from the sleeve by simply tapping the locking pin loose and pulling the locking pin out by hand. The operator pulls out the insert pin and the insert sleeve and replaces the insert pin with a new insert pin. The sleeve assembly also includes packing that the operator can remove, inspect and replace after removing the insert sleeve and the insert pin. The operator then pushes the insert sleeve and the new insert pin into the sleeve and places the locking pin back into place to secure the entire sleeve assembly.

The sleeve assembly design of the present invention allows the quick and easy replacement of insert pins and other sleeve assembly components because the entire sleeve remains attached to the bolster plate. As described above, quick part replacement is achieved by simply removing the locking pin from the sleeve and removing the insert pin, the insert sleeve or any other damaged components. The operator replaces any damaged components and secures them within the sleeve by inserting the locking pin into the sleeve. In addition, the operator need not spend time re-adjusting the location of the sleeve as in the current design.

The quick change insert system also solves some cost inefficiencies of the current design by permitting a reduction in inventory. The current design requires at least one fully assembled sleeve assembly per part because the components pressed into the sleeve are all part specific. The quick change insert system, however, utilizes sleeves, packings, insert sleeves and locking pins that are standard for a family of cold headers. The insert pins are part specific. Thus, the present invention not only saves significant time in cold header set-up and part to part changeover but also significantly reduces inventory because a fully assembled sleeve assembly is not required for each part. Instead, the present invention only requires an inventory of insert pins and the standard components for a family of cold headers.

BRIEF DESCRIPTION OF THE DRAWINGS

The advantages of the present invention will become apparent upon reading the following detailed description and upon reference to the accompanying drawings, in which.

DETAILED DESCRIPTION OF THE PREFERRED EMBODIMENT

Figure 1:
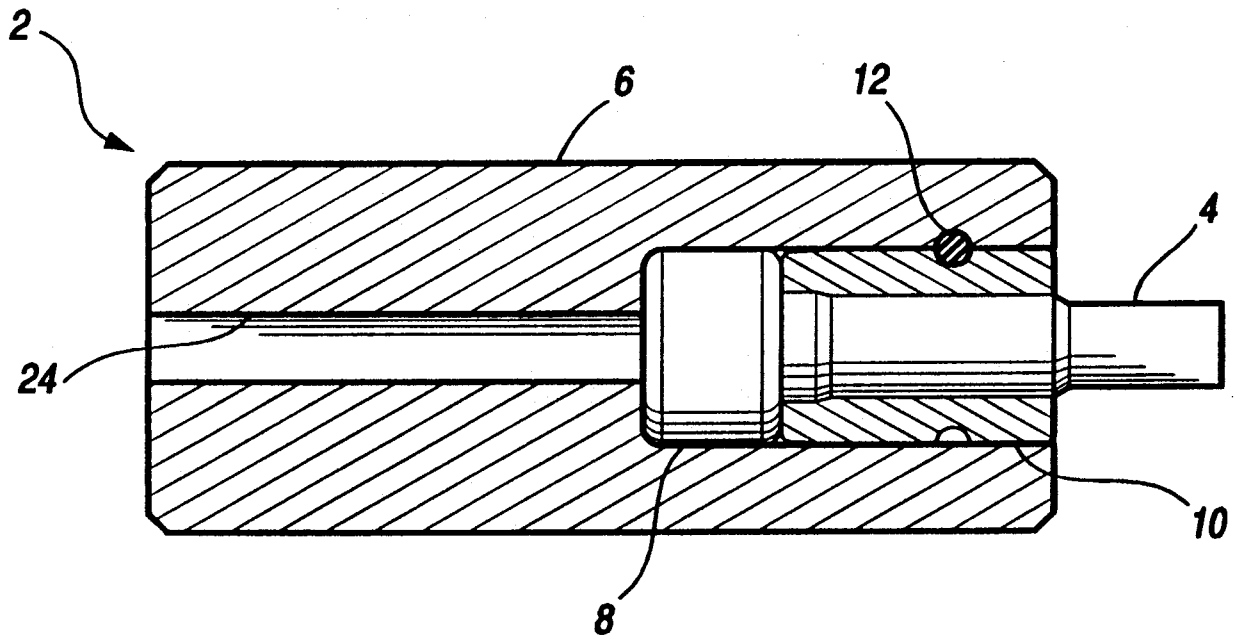
FIG. 1 shows a side view of a quick change insert system in accordance with the present invention.

Referring now to the drawings, and more particularly to FIG. 1, there is illustrated the quick change insert system in accordance with the present invention, generally designated by the reference numeral 2. In a preferred embodiment of the present invention, a cold-header used in the cold-forming industry utilizes the insert system 2. The quick change insert system 2 allows the quick and economical replacement of an insert pin 4 and other components within a sleeve 6 of the insert system 2 such as a packing 8 and a sleeve insert 10 during insert pin replacement and part to part changeover.

Figure 2:
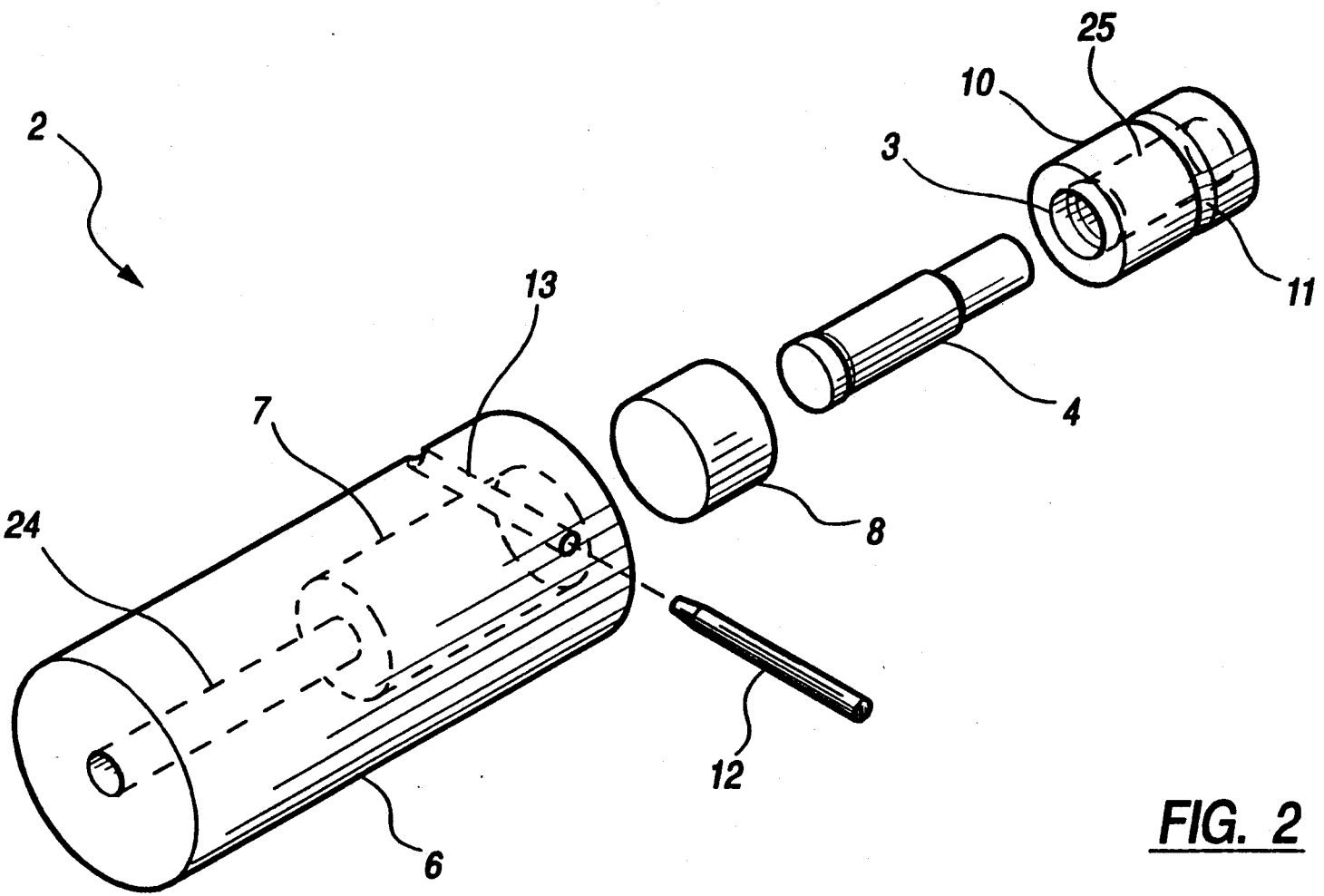
FIG. 2 shows an exploded view of the quick change insert system of FIG. 1.

As best seen in FIG. 2, an operator simply removes a locking pin 12 from a locking pin channel 13 of sleeve 6 and pulls out the insert pin 4 and sleeve insert 10 from an insert chamber 7 of the sleeve 6. The operator can also remove the packing 8 if inspection or replacement is desired. A second channel 24, having a smaller width than insert chamber 7, assists in removing any components that become jammed within the sleeve 6 by sticking a pin or other object into the second channel 24 and forcing the jammed components out of the insert chamber 7. The operator then separates the insert pin 4 and the sleeve insert 10 and pushes a new insert pin 4 into sleeve insert channel 25 of the sleeve insert 10 at the insert end 3. The insert pin 4 and the surface of the sleeve insert channel 25 are configured to position the insert pin 4 within the insert channel 25 of the sleeve insert 10. The operator then pushes the combination of the insert pin 4 and the sleeve insert 10 into the insert chamber 7 of the sleeve 6 and inserts the locking pin 12 into the locking pin channel 13 of the sleeve 6. The locking pin 12 passes through the locking pin channel 13 and a portion of a locking pin groove I 1 on the sleeve insert 10 that aligns with the locking pin channel 13 and locks the packing 8, the insert pin 4 and the sleeve insert 10 within the sleeve 6. The locking pin groove 11 is shown about the entire perimeter of the sleeve insert 10. In this way, the groove 11 is easier to align with the locking pin channel 13.

Figure 3:
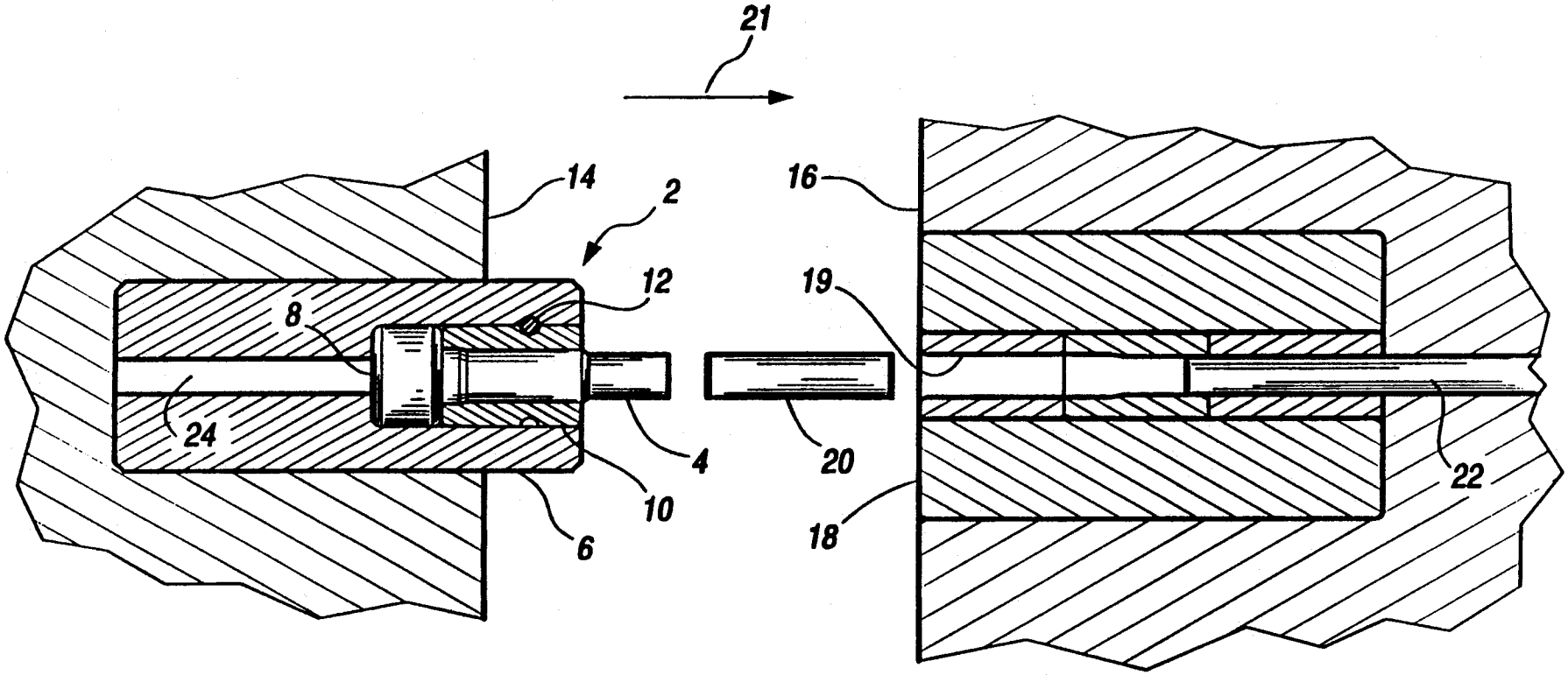
FIG. 3 illustrates the quick change insert system of FIG. 1 secured to the ram side of a cold header in a back position relative to the die side of the cold header.

As shown in FIG. 3, the sleeve 6 is attached to a ram side 14 of a cold header. The sleeve 6 remains attached to the ram side 14 and, thus, eliminates the time consuming process of removing and re-adjusting the sleeve 6 during insert pin replacement and part to part changeover. Instead, the operator removes the locking pin 12 and makes any necessary replacements as described above, saving a considerable amount of time and money.

FIG. 3 shows the quick change insert system 2 attached to the ram side 14 of a cold header in the back position. A die side 16 of the cold header has a die 18 with a die opening 19 opposite the insert pin 4. In the back position, a cut-off slug or blank 20 of the appropriate length lies between the insert pin 4 and the die opening 19. The ram side 14 moves in the direction of the arrow 21 to a forward position. The die side 16 remains stationary.

Figure 4:
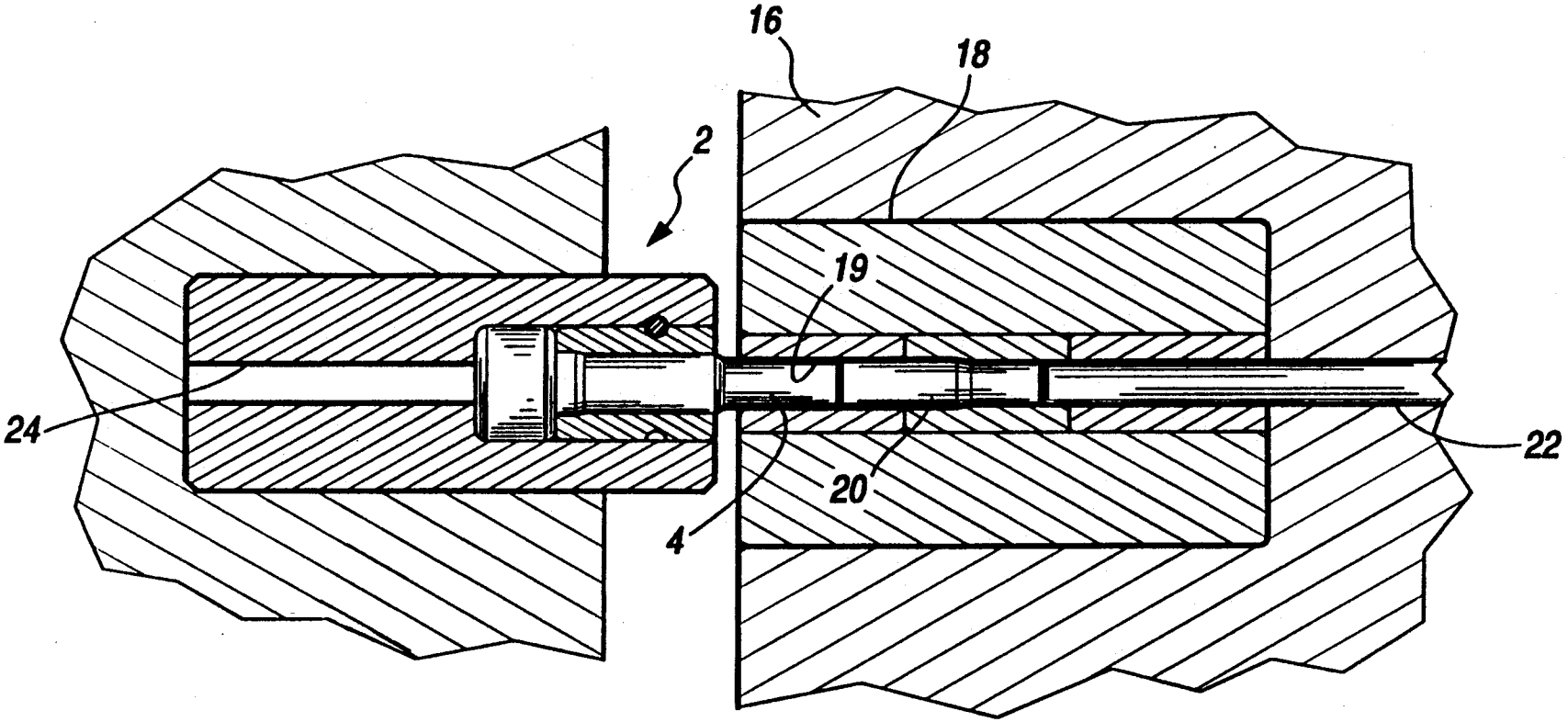
FIG. 4 illustrates the quick change insert system of FIG. 1 secured to the ram side of a cold header in a forward position relative to the die side of the cold header.

FIG. 4 shows the quick change insert system 2 attached to the ram side 14 of a cold header in the forward position. As the ram side 14 moves into the forward position, the insert pin 4 forces the blank 20 into the die 18 through the die opening 19. The blank 20 is extruded to the appropriate shape within the die 18. As the ram side 14 moves back to the back position, an ejector pin 22 ejects the extruded blank 20 from the die 18. The extruded blank 20 usually proceeds through a progression of cold forming operations in order to achieve the finished configuration.

During these cold-forming operations, insert pins and other components of the present invention frequently require replacement from damage or part to part changeover. The sleeve assembly design of the present invention allows the quick replacement of insert pins 4 and other sleeve assembly components because the sleeve 6 remains attached to the ram side 14. The operator need not spend time removing and re-adjusting the sleeve 6. The quick change insert system also reduces inventory. The quick change insert system utilizes sleeves, packings, insert sleeves and locking pins that are standard for a family of cold headers. The current design requires a fully assembled sleeve assembly per part because the components pressed into the sleeve are all part specific. Thus, the present invention not only saves significant time in cold header set-up and part to part changeover but also significantly reduces inventory because the present invention only requires an inventory of insert pins and the standard components for a family of cold headers.

The present invention has been described as being utilized by a cold header in the cold-forming industry. The present invention, however, can be used with the equipment of other industries including the hot-forming, nut-forming and punch press industries. Furthermore, the description of the present invention stresses that the present invention allows easy replacement of the insert pin, but the present invention provides easy replacement for a variety of parts.

Thus, the quick change insert system of the present invention and many of its attendant advantages will be understood from the foregoing description and various modifications may be made in the form, construction and arrangement of the parts thereof without departing from the spirit and scope of the invention or sacrificing all of its material advantages, the form described above being merely a preferred embodiment thereof.

What is claimed is:

1. A quick change insert system comprising:

a sleeve having a first end and a second end, said first end including an insert chamber and a locking pin channel, said sleeve being attached to a ram side of a cold header;

a sleeve insert having a locking pin groove and an insert pin channel, said sleeve insert slideable engaging said insert chamber of said sleeve;

an insert pin slideably engaging said insert pin channel of said sleeve insert; and a locking pin slideably engaging said locking pin channel of said sleeve and said locking pin groove of said sleeve insert to secure said sleeve insert and said insert pin within said insert chamber of said sleeve, said locking pin sliding out from said locking pin channel to enable the removal of said sleeve insert and said insert pin from said insert chamber by pulling said insert pin and sliding the combination of said sleeve insert and said insert pin from said insert chamber of said sleeve.

2. The quick change insert system of claim 1 wherein said sleeve insert having said locking pin groove about an entire perimeter of said sleeve insert.

3. The quick change insert system of claim 1 including a packing.

4. The quick change insert system of claim 1 wherein said insert pin having a first configuration and said insert pin channel of said insert sleeve having a second configuration, said first and second configurations controlling the position of said insert pin within said insert pin channel.

5. The quick change insert system of claim 4 wherein said insert pin sliding into a first end of said insert pin channel of said sleeve insert, said first end of said insert pin channel facing said second end of said sleeve when said sleeve insert is within said insert chamber of said sleeve.

6. The quick change insert system of claim 1 wherein a portion of said locking pin channel of said sleeve and a portion of said locking pin groove of said sleeve insert form a single channel.

7. The quick change insert system of claim 1 including a second channel in said sleeve leading from said second end of said sleeve to said insert chamber, said second channel having a smaller width than said insert channel.

8. A quick change insert system comprising:

a sleeve having a first end and a second end, said first end including an insert chamber, a locking pin channel and a chamber opening, said sleeve being attached to a ram side of a cold header;

a sleeve insert having a locking pin groove about a perimeter of said sleeve insert and an insert pin channel, said sleeve insert slideably engaging said insert chamber of said sleeve, said locking pin groove aligning with said locking pin channel of said sleeve when said sleeve insert is engaging said insert chamber of said sleeve, said insert pin channel having a first end and a first configuration;

an insert pin having a second configuration, said insert pin slideably engaging said insert pin channel, said insert pin sliding into said first end of said insert pin channel of said sleeve insert, said first configuration of said insert pin channel and said second configuration of said insert pin controlling the position of said insert pin within said insert pin channel of said sleeve insert; and a locking pin slideably engaging said locking pin channel of said sleeve and said locking pin groove of said sleeve insert to secure said sleeve insert and said insert pin within said insert chamber of said sleeve, said locking pin sliding out from said locking pin channel to enable the removal of said sleeve insert and said insert pin from said insert chamber by pulling on said insert pin and sliding the combination of said sleeve insert and said insert pin from said insert chamber of said sleeve.

9. The quick change insert system of claim 8 including packing.

10. The quick change insert system of claim 8 wherein said sleeve insert engages said insert chamber of said sleeve with said first end of said insert pin channel of said sleeve insert facing said second end of said sleeve.

11. The quick change insert system of claim 8 including a second channel in said sleeve leading from said second end of said sleeve to said insert chamber, said second channel having a smaller width than said insert channel.

12. The quick change insert system of claim 8 wherein a portion of said locking pin channel of said sleeve and a portion of said locking pin groove of said sleeve insert form a single channel.

13. A quick change insert system comprising:

a sleeve having a first end and a second end, said first end including an insert chamber, a locking pin channel and a chamber opening, said sleeve further including a second channel leading from said second end of said sleeve to said insert chamber, said second channel having a smaller width than said insert chamber, said sleeve being attached to a ram side of a cold header;

a sleeve insert having a locking pin groove about an entire perimeter of said sleeve insert and an insert pin channel, said sleeve insert slideably engaging said insert chamber of said sleeve through said chamber opening, a portion of said locking pin groove and a portion of said locking pin channel of said sleeve forming a single channel when said sleeve insert is engaging said insert chamber of said sleeve, said insert pin channel having a first end and a first configuration, said insert pin sliding into said insert chamber with said first end of said insert pin channel facing said second end of said sleeve;

an insert pin having a second configuration, said insert pin slideably engaging said insert pin channel, said insert pin sliding into said first end of said insert pin channel of said sleeve insert, said first configuration of said insert pin channel and said second configuration of said insert pin controlling the position of said insert pin within said insert pin channel; and a locking pin slideably engaging said single channel formed by said locking pin groove of said sleeve insert and said locking pin channel of said sleeve to secure said sleeve insert and said insert pin within said insert chamber of said sleeves, said locking pin sliding out from said locking pin channel to enable the removal of said sleeve insert and said insert pin from said insert chamber by pulling on said insert pin and sliding the combination of said sleeve insert and said insert pin from said insert chamber of said sleeve.

14. The quick change insert system of claim 13 including packing.

* * * * *